US007845427B2

(12) United States Patent
Wan et al.

(10) Patent No.: US 7,845,427 B2
(45) Date of Patent: Dec. 7, 2010

(54) SEALING ELEMENT OF HAND POWER TOOL HOUSING

(75) Inventors: Mahsein Wan, Bukit Mertajam Penang (MY); Manfred Lutz, Filderstadt (DE); Siew Yuen Lee, Penang (MY)

(73) Assignee: Robert Bosch GmbH, Stuttgart (DE)

( * ) Notice: Subject to any disclaimer, the term of this patent is extended or adjusted under 35 U.S.C. 154(b) by 297 days.

(21) Appl. No.: 11/670,706

(22) Filed: Feb. 2, 2007

(65) Prior Publication Data

US 2007/0256847 A1 Nov. 8, 2007

(30) Foreign Application Priority Data

May 2, 2006 (DE) ..... 10 2006 020 172

(51) Int. Cl.
*B25D 17/04* (2006.01)

(52) U.S. Cl. ..... 173/162.1; 173/217; 173/168; 173/162.2

(58) Field of Classification Search ..... 173/162.1, 173/217, 168, 162.2
See application file for complete search history.

(56) References Cited

U.S. PATENT DOCUMENTS 4,121,631 A * 10/1978 Jones ..... 141/27
4,422,841 A * 12/1983 Alfonsi et al. ..... 425/548
4,426,175 A * 1/1984 Lin ..... 405/237
4,516,468 A * 5/1985 Sheriff ..... 91/169
4,527,675 A * 7/1985 Omata et al. ..... 188/290
5,375,666 A * 12/1994 Pettet et al. ..... 173/162.1
5,447,206 A * 9/1995 Coleman et al. ..... 173/170
5,451,127 A * 9/1995 Chung ..... 408/20
6,149,356 A * 11/2000 Chu et al. ..... 408/56
2002/0096341 A1* 7/2002 Hagan et al. ..... 173/170
2002/0104666 A1* 8/2002 McCallops et al. ..... 173/168
2003/0107273 A1 6/2003 Ikeda et al.
2005/0048884 A1 3/2005 Baker
2005/0155778 A1* 7/2005 Ishida et al. ..... 173/217
2005/0224244 A1 10/2005 Kraenzler et al.
2008/0041603 A1* 2/2008 Wiker et al. ..... 173/162.1
2008/0053676 A1* 3/2008 Baumann ..... 173/217

FOREIGN PATENT DOCUMENTS

JP 2002-254357 9/2002
WO 2005/021193 3/2005

* cited by examiner

*Primary Examiner*—Brian D Nash
(74) *Attorney, Agent, or Firm*—Michael J. Striker

(57) ABSTRACT

A hand power tool has a housing comprising at least two housing parts, and at least one sealing and/or damping element introduced into the housing by injection molding.

11 Claims, 5 Drawing Sheets

SEALING ELEMENT OF HAND POWER TOOL HOUSING

CROSS-REFERENCE TO A RELATED APPLICATION

The invention described and claimed hereinbelow is also described in German Patent Application DE 102006020172.8 filed on May 2, 2006. This German Patent Application, whose subject matter is incorporated here by reference, provides the basis for a claim of priority of invention under 35 U.S.C. 119(a)-(d).

BACKGROUND OF THE INVENTION

The invention relates to a hand power tool and to a method for producing a hand power tool.

Hand power tools, such as drilling screwdrivers, drill hammers, and rotary percussion screwdrivers, typically have a plastic housing with two half shells, which are put together along a longitudinal axis of the hand power tool. For holding the gear and/or a tool insert, a separate gearbox is provided, which is joined to the housing half shells. Since the gear in many cases must be lubricated with lubricants, the joining region between the housing half shells and the gearbox must be sealed off, to prevent lubricant from escaping from the housing. A further consideration is that particularly in hand power tools with percussion mechanisms, such as drill hammers, power percussion drills, and percussion screwdrivers, good noise and vibration damping is required. For sealing and/or for vibration and noise damping, sealing rings, for instance of synthetic rubber, are typically manufactured separately and placed in the housing of the hand power tool.

It is already known from the prior art to inject a thermoplastic elastomer integrally from outside onto the housing, for instance in the region of a grip of a hand power tool, creating a soft grip, to improve the grip and increase its resistance to slipping when in use.

SUMMARY OF THE INVENTION

In the hand power tool of the invention, the housing which receives the components of the hand power tool, such as the electric motor and gear, has at least two housing parts. The housing parts are joined together, in particular detachably. At least one, in particular annular sealing and/or damping element is provided. According to the invention, the sealing and/or damping element is introduced into the housing by injection molding.

A further subject of the invention is a method for producing a hand power tool of the invention; the method of the invention is distinguished in that the sealing and/or damping element is introduced into the housing by injection molding.

Introducing the sealing and/or damping element by injection molding has the advantage that the hand power tool can be produced simply, since the sealing and/or damping element is not a separate molded part that must be produced in a separate method and then inserted into the housing. Instead, both the production of the housing and the sealing of joining points and/or the damping of noise and vibration can be achieved by means of one method.

If the housing is likewise of plastic, for instance, then a two-component injection molding process can be employed. In an injection molding tool with two cavities, the housing for instance can be molded in a first cavity with a thermoplastic plastic, and after the setting of the housing molded in the first cavity, the sealing and/or damping element can be molded in a second cavity, using a thermoplastic elastomer. The sealing and/or damping element is injected directly into the housing; that is, the sealing and/or damping element is integrally injected onto an inner wall of the housing. Alternatively, the introduction of the sealing and/or damping element can be done into two injection molding tools, where the housing is molded in a first tool and the sealing and/or damping element is molded in a second tool.

The sealing and/or damping element in particular comprises a thermoplastic elastomer.

Hereinafter for the sake of simplicity, the sealing and/or damping element will simply be called a sealing element.

In the housing, particularly at the inner wall of the housing, a receiving groove for receiving the sealing element is preferably provided, so that the thermoplastic elastomer upon injection forms a form lock with the receiving groove of the housing. To reinforce the form lock between the housing and the sealing element integrally injected onto it, the receiving groove can additionally be provided with bores, indentations, beads, or the like, into which the thermoplastic elastomer penetrates on being integrally injected.

In a preferred embodiment, the housing has an opening through which the sealing element reaches. In particular, the sealing element reaches far enough through the opening in the housing that the sealing element forms a contact point or contact face for the hand power tool, when the hand power tool is set down on one side face on a surface. This means that when the hand power tool is lying on its side, the sealing element forms the highest elevation or in other words the highest point or the highest surface that protrudes past the housing. Accordingly, the opening in the housing is preferably located on a side face of the hand power tool, in particular in a region which because of the shape of the housing serves as a contact point or contact face when the hand power tool is set down. The sealing means comprising a thermoplastic elastomer thus additionally takes on the function of a slip prevention element, since it increases the slip resistance, for instance on a sloping surface.

This embodiment, in which the sealing element is embodied integrally with a slip prevention element, has the advantage that both elements can be integrally injected onto the housing in one method step, in particular through a single integral injection point. The slip prevention element can additionally be provided on the contact face with a profile, such as bumps or grooves, to increase the slip resistance still further.

The housing of the hand power tool comprises at least two housing parts. These may for instance be two housing half shells, which can be joined in a longitudinal axis. However, the housing may also comprise two housing parts that can be joined in a transverse axis, for instance, of the hand power tool. The housing parts may for instance be of plastic or metal. They may be joined together for instance by a screw connection, detent connection, or plug connection, or by a combination of such connections.

In a feature of the hand power tool of the invention, one housing part can be joined to another housing part in a transverse axis of the hand power tool, and the sealing and/or damping element is located in the joining region between the two housing parts. One housing part may for instance be a motor housing of cup-type construction, while the other housing part for instance forms a gearbox with a receptacle (such as a chuck) for a tool insert that forms the head of the hand power tool. The sealing element is located in the joining region between the two housing parts, for instance to prevent the lubricant from escaping from the housing. The sealing element is essentially annular, and the annular form may be circular, oval, or elliptical.

In a further feature, one housing part comprises at least two housing half shells, which can be joined in a longitudinal axis of the hand power tool, and the sealing and/or damping element in the form of two half rings is introduced into the housing by injection molding. Each half ring is located in one housing half shell. If the two housing half shells are placed against one another and joined together, for instance by detent elements and/or screws, then the two half rings complete one another to form a substantially annular sealing and/or damping element, which again can be circular, oval, or elliptical.

In addition or alternatively, in the case of a housing comprising at least two half shells, one or more sealing elements may also be provided in their joining region in the longitudinal axis, in other words along the joining line.

Further combinations of housing parts which together form a housing of a hand power tool are possible. Sealing elements may be provided at least in the joining regions of the housing parts. The joining regions can extend longitudinally or transversely, for instance, or in an arbitrary direction.

In a further feature, the sealing and/or damping element is located in the housing in the region of the electric motor, in particular in the region of a bearing of the armature shaft of the electric motor. In addition or alternatively, a sealing and/or damping element may also be located in the housing in the region of the gear. Also in these regions of the hand power tool, because of the sealing and/or damping element of the invention, a separate sealing ring can be dispensed with.

The hand power tool of the invention includes at least one sealing and/or damping element. If a plurality of joining regions have to be sealed off, or if vibration damping and/or noise damping is necessary in multiple regions of the hand power tool, then the sealing and/or damping element may also be embodied in multiple parts. A plurality of sealing elements may be joined together, for instance by injecting a thermoplastic elastomer, for instance via an integral injection point, into the housing in only one region, with the molten elastomer then being distributed via conduits to a plurality of regions in the housing. If there is a plurality of sealing and/or damping elements that are required in the interior of the housing, this saves additional work steps and method steps, since separate sealing and/or damping elements no longer have to be produced and introduced into the housing.

In a preferred embodiment of the hand power tool of the invention, an elastomer, in particular a thermoplastic elastomer, is integrally injected onto the housing from outside at least in part. The thermoplastic elastomer is preferably integrally injected in the region of the grip, to enhance the grip and resistance to slipping (soft grip). However, it can also be integrally injected onto the housing from outside in other regions, in addition or as an alternative. Especially preferably, this involves the same thermoplastic elastomer as is used for integral injection of the sealing and/or damping element. This has the advantage that the integral injection can be done into the interior of the housing and onto the exterior of the housing in one injection molding tool, in particular in one method step. It is also possible for the regions integrally injected from outside to be joined to the sealing elements integrally injected in the housing. In integral injection through bores in the housing, for instance, the molten thermoplastic elastomer can then flow from the outside inward or conversely from inward outward along conduits. This has the advantage that only a few integral injection points are needed for integrally injecting the thermoplastic elastomer onto the housing from the outside and inside at a plurality of points.

The hand power tool of the invention may be the most various kinds of hand power tools, whether operated by rechargeable batteries or plugged in, such as drilling screwdrivers, drill hammers, rotary percussion screwdrivers, power percussion drills, power drills, circular saws, right-angle sanders, and many others.

The novel features of which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
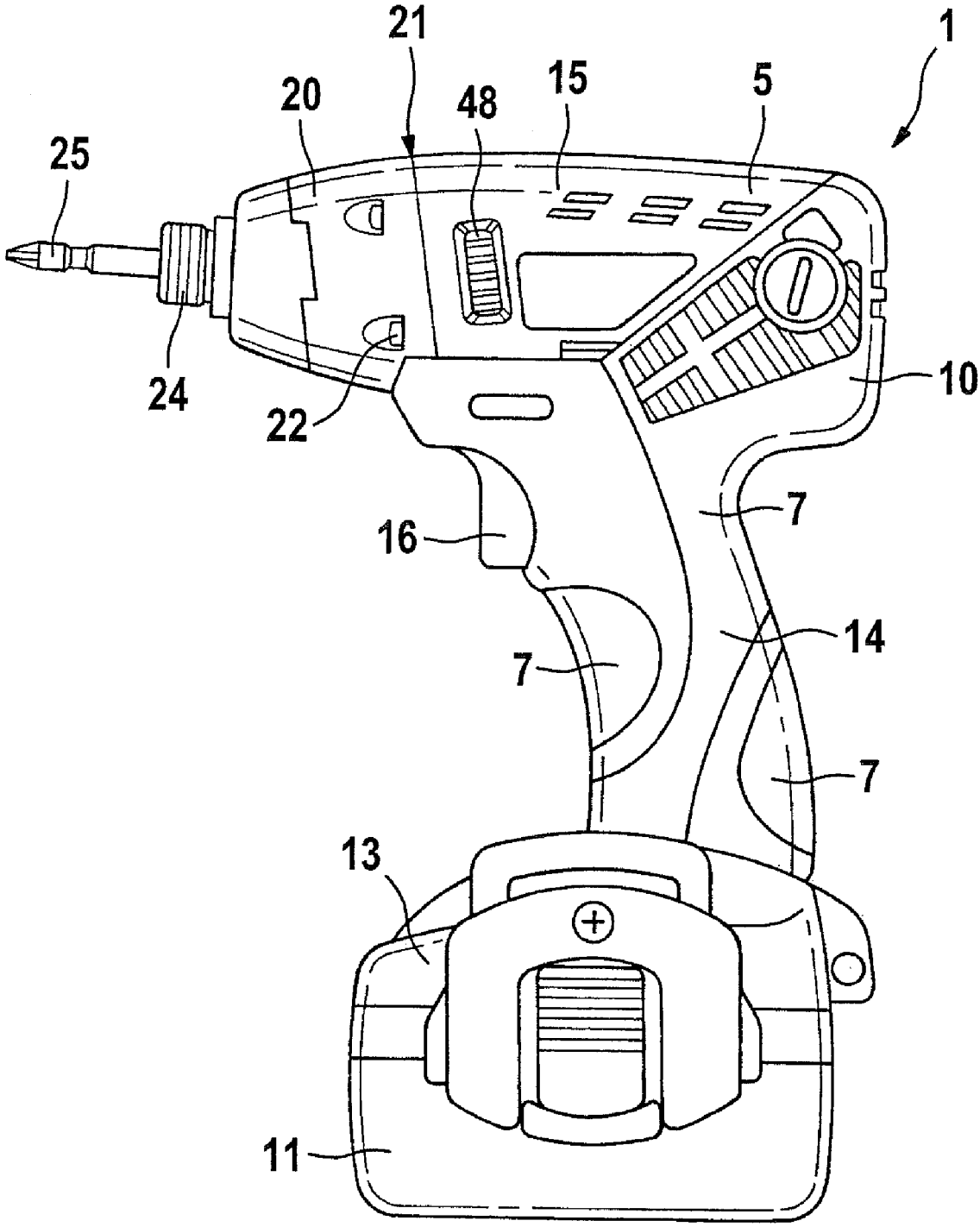
FIG. 1 shows one embodiment of a hand power tool of the invention in plan view.

In the embodiment shown in FIG. 1, the hand power tool 1 of the invention is a rotary percussion screwdriver. The housing 10, of plastic and in particular thermoplastic plastic, comprises two half shells 12 (FIG. 3), which are placed against one another in form-locking fashion in a longitudinal axis of the hand power tool 1 along the joining region 17 (FIG. 4) and are joined together by screws (not shown). The housing 10 forms a pistol-like grip 14, a lower part 13 angled relative to the grip 14, and an upper part 15 that substantially forms a T shape with the grip 14. An on/off switch 16 in the form of a push button is located in the region of the grip 14. The upper part 15 receives the electric motor 30 (FIG. 6), among other elements. A rechargeable battery 11 for supplying voltage is mounted on the underside of the lower part 13. In the front region of the upper part 15, in a transverse axis of the hand power tool 1, a gearbox 20 of metal is flush with the housing 10 and is detachably joined to the housing 10 with screws 22.

The region where the gearbox 20 is located on the housing 10 and joined to it will also be referred to here as the joining region 21. The gearbox 20 serves to receive a gear (not shown) that is connected to the electric motor 30. In the front region, the gearbox 20 is equipped with a chuck 24 for receiving a tool insert 25. In FIG. 1, regions 7 can also be seen on the outside of the housing 5 in which a thermoplastic elastomer is integrally injected onto it to make a soft grip for enhancing the resistance to slipping and improve the grip. The regions 7 may be integrally injected separately or joined together by causing the thermoplastic elastomer to pass inward into the housing 5 through bores (not shown) and emerging to the outside again at one or more other points 7, again through bores in the housing 5.

Figure 2A:
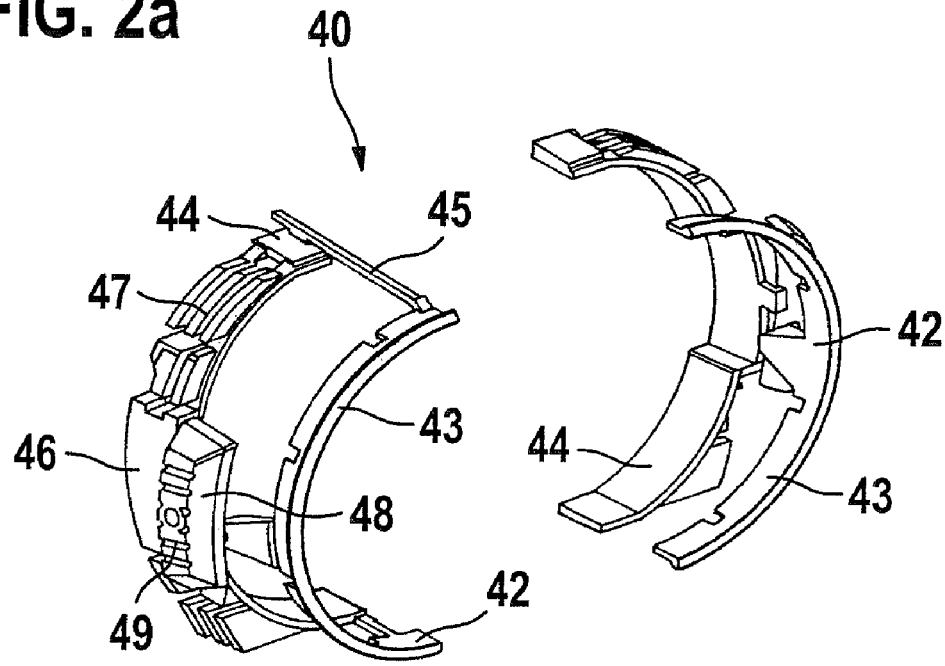
FIG. 2*a* shows one embodiment of the sealing and/or damping element in an exploded view.
Figure 2B:
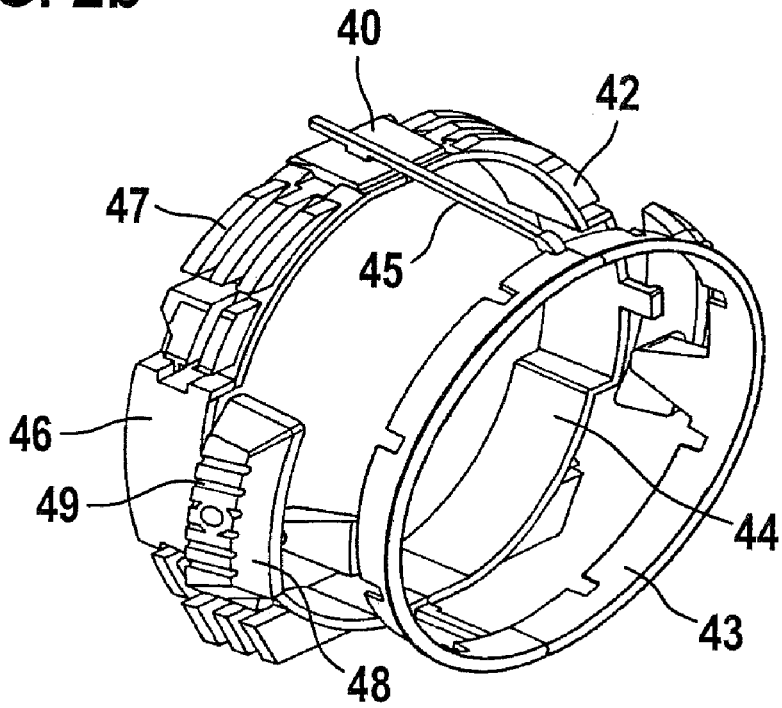
FIG. 2*b* shows the sealing and/or damping element of FIG. 2*a* in perspective.
Figure 3:
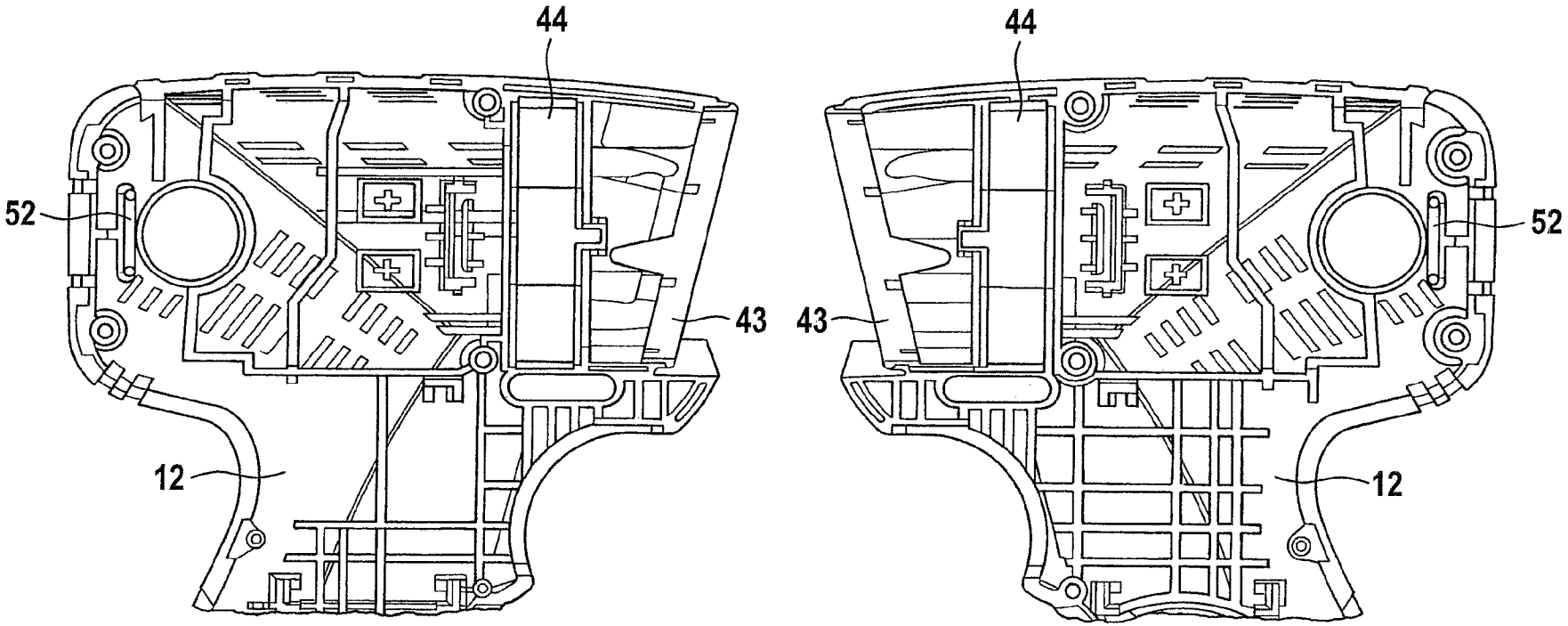
FIG. 3 shows two half shells, forming the housing of the hand power tool of FIG. 1, in plan view.

FIG. 2*a* shows a sealing and/or damping element 40, which comprises two half rings 42, in an exploded view, while FIG. 2*b* shows the annular sealing and/or damping element 40 in the put-together form. As can be seen in FIG. 3, each of the two half rings 42 is received in one housing half shell 12.

When the two half shells 12 are put together, the two half rings 42 also joined together and thus in the assembled state form one annular sealing element 40.

The half rings 42 that form the sealing element 40 are introduced into the housing half shells 12 in the joining region 21 by injection molding. The half rings 42 are each injected into one receiving groove 18 (FIG. 4) of the half shells 12. To strengthen the form lock between the sealing element 40 and the half shell 12, the receiving groove 18 is embodied in profiled form at least in part. Accordingly, the inside of an outer face 46, facing toward a half shell 12, of a half ring 42 likewise at least partially has a profiled structure, for instance in the form of grooves 47.

Figure 4:
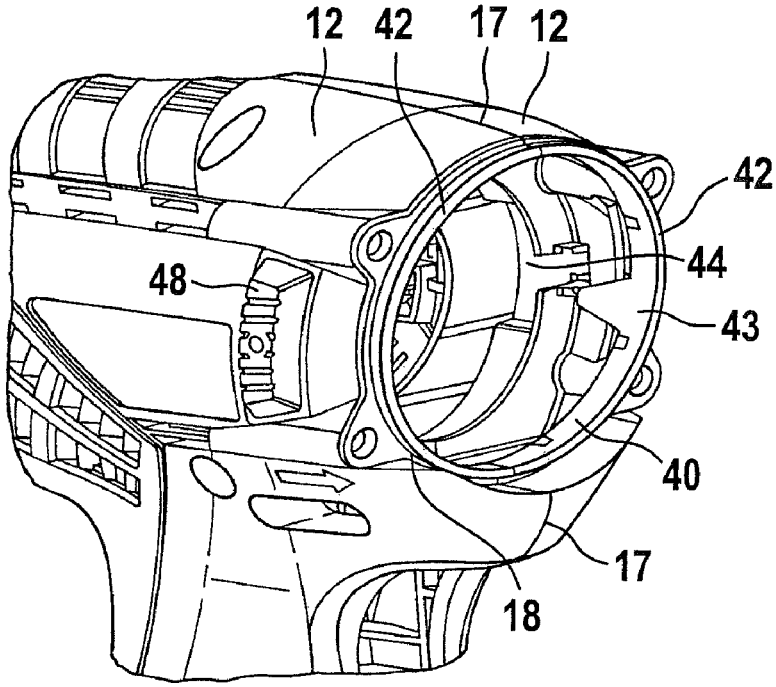
FIG. 4 is a detail in perspective of the housing of the hand power tool of FIG. 1.
Figure 5:
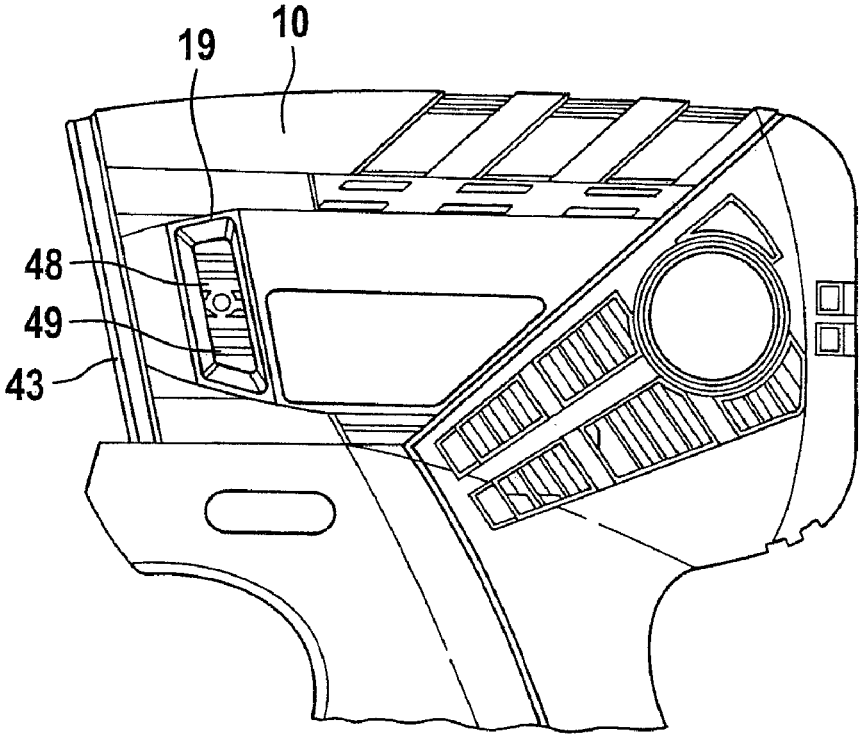
FIG. 5 is a detail in a plan view on the housing of the hand power tool of FIG. 1.

In the embodiment shown in FIGS. 2*a* and 2*b*, each of the two half rings 42 is embodied in two parts, so that each half ring 42 comprises two joined-together half rings 43 and 44. This has the advantage of saving material, since thermoplastic elastomer is integrally injected only where it is necessary for the sake of sealing and/or damping purposes. If each of the half rings 42 are formed in one piece of two (or more) half rings 43, 44, this has the advantage that in the most favorable case, only one integral injection point for one two-part (or multiple-part) half ring 42. In FIGS. 4 and 5, it can be seen that the sealing element 40 with the two half rings 43 in the joining region 21 between the housing 10 and the housing part 20 forms one encompassing sealing ring. The two half rings 44, in the embodiment shown, are located such that they serve the purpose of damping the gear and sealing off the gear compartment from the motor compartment. The inside faces of the half rings 44 contact a gear, not shown, such as a ring of a planetary gear, in such a way that the gear is supported in a vibrationally damped way.

One of the two half rings 42 has a piece 45 that extends in the longitudinal direction of the hand power tool 1 between the half rings 43, 44. In the assembled state, this portion 45 extends along the longitudinally extending joining region 17 between the two half shells 12 and thus additionally seals off the joining region 17 in the joining region 21 between the housing 10 and the gearbox 20.

The embodiment shown in FIGS. 2*a* and 2*b* of a sealing and/or damping element 40 shows an additional function of the sealing and/or damping element 40. The sealing element 40 additionally takes on the function of a slip prevention element. To that end, at least one housing half shell 12 has an opening 19, through which the sealing element 40 reaches far enough that the sealing element 40 protrudes out of the housing 10. The sealing element 40 protrudes far enough out of the housing 10 that informs the highest elevation, that is, the highest point or highest surface, relative to the housing 10.

In this way, the sealing element 40 forms a contact face 48 for the hand power tool 1 when the hand power tool 1 is set down on one of its side faces on a surface. When the hand power tool 1 is lying on its side, the sealing element 40 thus additionally serves as a slip prevention element, since it prevents the hand power tool 1 from slipping if it is on a slanting surface. To enhance the resistance to slipping still further, grooves 49 are provided on the contact face 48, in the embodiment of the sealing element 40 shown.

Figure 6:
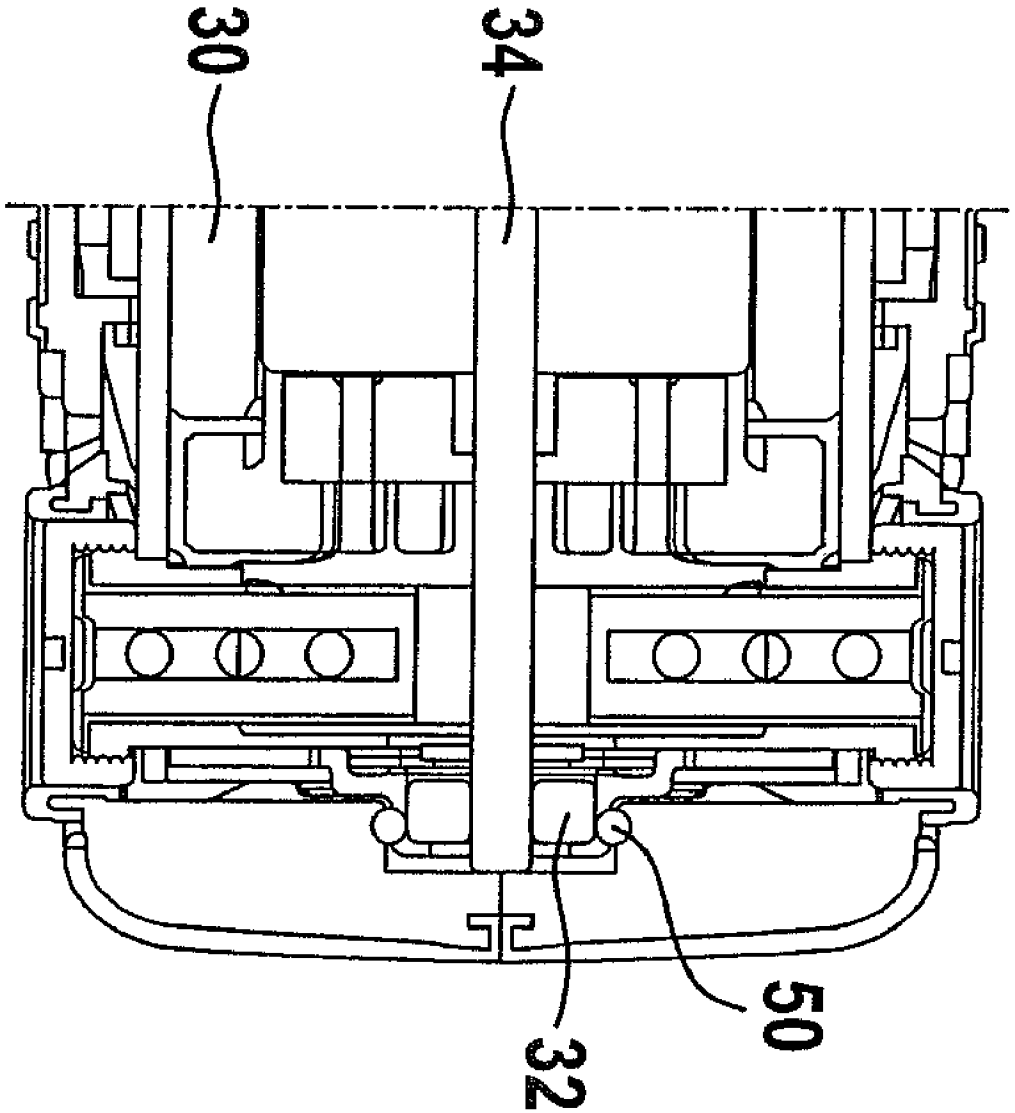
FIG. 6 is a detail of a different embodiment of the hand power tool of the invention, in cross section.

In a further feature shown in FIG. 6, a sealing and/or damping element 50 is located in the housing 10 in the region of the electric motor 30, in particular in the region of a bearing 32 of the armature shaft 34 of the electric motor 30. The sealing and/or damping element 50 is likewise integrally molded into the housing half shells 12 of a thermoplastic elastomer by injection molding. As FIG. 3 shows, one half ring 52 is integrally injected into each of the two half shells 12. Upon joining of the two half shells 12 along the longitudinal axis, the two half rings 52 together make one substantially annular sealing and/or damping element 50.

It will be understood that each of the elements described above, or two or more together, may also find a useful application in other types of constructions differing from the type described above.

While the invention has been illustrated and described as embodied in a hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A hand power tool, comprising:

a housing having an inner wall;

at least one element selected from the group consisting of a sealing element and a damping element and sealing and damping the housing, said at least one element being configured as an injection-molded element which is introduced into said housing by injection molding onto said inner wall of said housing integrally with said inner wall by being received in at least one receiving groove provided in the inner wall; said at least one element is an annular element which covers said inner wall of said housing and is hollow inside, and wherein the at least one element reaches outward from inward of the housing through at least one opening in the housing, wherein said at least one of said housing parts includes at least two housing half shells which are joinable in a longitudinal axis of the hand power tool, said at least one element including two half rings and each of said half rings is located in a respective one of said housing half shells.

2. A hand power tool as defined in claim 1, wherein said at least two housing half shells are joinable in a longitudinal axis of the hand power tool, said at least one element being located in a joining region of the housing half shells along said longitudinal axis.

3. A hand power tool, comprising:

a housing having an inner wall;

at least one element selected from the group consisting of a sealing element and a damping element and sealing and damping the housing, said at least one element being configured as an injection-molded element which is introduced into said housing by injection molding onto said inner wall of said housing integrally with said inner wall by being received in at least one receiving groove provided in the inner wall; said at least one element has an annular shape with an exterior which is attached to and covers said inner wall of said housing and an interior which is hollow inside, and wherein the at least one element reaches outward from inward of the housing through at least one opening in the housing.

4. A hand power tool as defined in claim 3, wherein said at least one element includes an elastomer.

5. A hand power tool as defined in claim 3, wherein said at least one element includes a thermoplastic elastomer.

6. A hand power tool as defined in claim 3, wherein said at least one element reaches so far through said opening to form a contact selected from the group consisting of a contact point and a contact face for the hand power tool.

7. A hand power tool as defined in claim 3, wherein one of said housing parts is joinable to the other of said housing parts in a transverse axis of the hand power tool, said at least one element being located in a joining region between said housing parts.

8. A hand power tool as defined in claim 3; and further comprising a unit selected from the group consisting of an electric motor and a gear and provided in said housing, said at least one element being located in a region of said unit.

9. A hand power tool as defined in claim 8, wherein said electric motor has an armature shaft which is supported in at least one bearing, said at least one element being located in a region of said bearing.

10. A hand power tool as defined in claim 3, wherein a thermoplastic elastomer is at least partly integrally injection-placed onto said housing from outside.

11. A method for producing a hand power tool, comprising the steps of forming a housing having an inner wall; introducing at least one annular element selected from the group consisting of a sealing element and a damping element, said one element having an annular shape with an exterior which is attached to and covers the inner wall of the housing and an interior which is hollow inside and configured as an injection-molded element, into said housing by injection molding onto said inner wall integrally with said inner wall by being received in at least one receiving groove provided in the inner wall; and reaching with the at least one element outward from inward of the housing through at least one opening in the housing.

* * * * *